US010383448B1

(12) United States Patent
VerBeek et al.

(10) Patent No.: US 10,383,448 B1
(45) Date of Patent: Aug. 20, 2019

(54) FORWARD TILT ASSEMBLY FOR CHAIR SEAT

(71) Applicant: Haworth, Inc., Holland, MI (US)

(72) Inventors: Adam Brice VerBeek, Holland, MI (US); William Francis Schroeder, II, Jenison, MI (US); Stephen Joseph Simpson, Grand Rapids, MI (US); Jon Jacob Swingle, II, Fennville, MI (US); Craig William Brekke, Rockford, MI (US)

(73) Assignee: Haworth, Inc., Holland, MI (US)

( * ) Notice: Subject to any disclaimer, the term of this patent is extended or adjusted under 35 U.S.C. 154(b) by 14 days.

(21) Appl. No.: 15/938,333

(22) Filed: Mar. 28, 2018

(51) Int. Cl.

| | |
|---|---|
| ***A47C 3/026*** | (2006.01) |
| ***A47C 7/56*** | (2006.01) |
| ***A47C 9/02*** | (2006.01) |
| ***A47C 7/60*** | (2006.01) |

(52) U.S. Cl.
CPC ..... *A47C 7/566* (2013.01); *A47C 7/563* (2013.01); *A47C 7/60* (2013.01); *A47C 9/02* (2013.01)

(58) Field of Classification Search
CPC ..... A47C 7/566; A47C 7/563; A47C 7/60; A47C 9/02; A47C 1/03255; A47C 3/026
See application file for complete search history.

(56) References Cited

U.S. PATENT DOCUMENTS 5,685,607 A * 11/1997 Hirschmann ..... A47C 1/0325 297/300.8
5,772,282 A 6/1998 Stumpf et al.
5,909,924 A * 6/1999 Roslund, Jr. ..... A47C 1/03255 297/300.4
6,000,755 A 12/1999 Uhlenbrock
6,033,021 A 3/2000 Udo et al.
6,039,398 A 3/2000 Gorgi et al.
6,161,897 A 12/2000 Kurtz et al.
6,234,573 B1 5/2001 Röder et al.
6,283,549 B1 * 9/2001 Husemann ..... A47C 1/024 297/300.8
6,286,900 B1 9/2001 Roark
6,378,943 B1 4/2002 Beggs et al.
(Continued)

FOREIGN PATENT DOCUMENTS

WO 2011032689 A1 3/2011
WO 2012115700 A3 11/2012
(Continued)

*Primary Examiner* — Philip F Gabler
(74) *Attorney, Agent, or Firm* — Warner Norcross + Judd LLP

(57) ABSTRACT

A forward tilt assembly configured to tilt forward a seat of a chair. The forward tilt assembly includes a base, a seat plate, and a release mechanism. The seat plate is pivotally mounted to the base and includes two support brackets on the sides of the seat plate. Each support bracket includes a keyhole slot. The release mechanism is operable between locked and unlocked positions and includes a slidable lock pin mounted between the support brackets. The release mechanism includes two keyed collars, one disposed at each end of the lock pin. The collars are received in respective keyhole slots of the support brackets. When the release mechanism is in the unlocked position, the collars are unobstructed from moving within the keyhole slots, and the seat plate can pivot relative to the base, thereby tilting a rear of the chair seat.

20 Claims, 13 Drawing Sheets

(56) References Cited

U.S. PATENT DOCUMENTS 6,382,724 B1 5/2002 Piretti
6,447,063 B1 9/2002 Beggs
6,523,896 B1 2/2003 Uhlenbrock
6,572,191 B2 6/2003 Wild
6,644,741 B2 11/2003 Nelson et al.
6,685,267 B1 * 2/2004 Johnson ..... A47C 1/023 297/300.1
6,685,268 B2 2/2004 Meyer
6,709,057 B2 3/2004 Sander et al.
6,796,611 B2 9/2004 Bock
6,817,667 B2 11/2004 Pennington et al.
6,874,853 B2 4/2005 Wild
6,890,030 B2 5/2005 Wilkerson et al.
6,896,328 B2 5/2005 Goodworth
6,945,602 B2 9/2005 Fookes et al.
6,959,965 B2 11/2005 Diffrient
7,014,262 B2 3/2006 Rossetto et al.
7,066,537 B2 6/2006 Coffield et al.
7,066,538 B2 6/2006 Machael et al.
7,073,860 B2 7/2006 Markus
7,090,296 B2 8/2006 Massimo
7,234,772 B2 6/2007 Wells
7,281,764 B2 10/2007 Thole
7,287,815 B2 10/2007 Leguen et al.
7,387,339 B2 6/2008 Bykov et al.
7,396,080 B2 7/2008 Suhr et al.
7,425,037 B2 9/2008 Schmitz et al.
7,427,105 B2 9/2008 Knoblock et al.
7,431,397 B2 10/2008 Link
7,497,516 B2 3/2009 Wullum
7,500,718 B2 3/2009 Fookes
7,503,626 B2 * 3/2009 Maier ..... A47C 1/03205 297/300.2
7,547,067 B2 6/2009 Keilhauer et al.
7,568,765 B2 8/2009 Bräuning
7,806,478 B1 10/2010 Cvek
7,819,473 B2 10/2010 Fukai
7,841,664 B2 11/2010 Holdredge et al.
7,866,749 B2 * 1/2011 Costaglia ..... A47C 1/03238 297/300.5
7,922,247 B2 4/2011 Dickie
7,922,248 B2 * 4/2011 Aldrich ..... A47C 1/023 297/316
7,946,972 B2 5/2011 Guissin et al.
7,997,652 B2 8/2011 Roslund et al.
8,042,867 B2 10/2011 Meister et al.
8,118,366 B2 2/2012 Matveev
8,146,990 B2 4/2012 Bock
8,297,702 B2 * 10/2012 Costaglia ..... A47C 1/022 297/313
8,414,073 B2 4/2013 Schmitz et al.
8,465,091 B2 6/2013 Su
8,485,604 B2 7/2013 Pfeifer et al.
8,544,955 B2 10/2013 Kim
8,550,557 B2 10/2013 Bock
8,556,345 B2 10/2013 Huang
8,585,144 B2 11/2013 Huttenhuis
8,613,482 B2 12/2013 Ni
8,646,839 B2 2/2014 Moreschi
8,721,000 B2 5/2014 Nguyen et al.
8,864,230 B2 10/2014 Augustat
8,899,680 B2 12/2014 Meier et al.
9,022,476 B2 5/2015 Battey et al.
9,211,013 B2 12/2015 Harrison et al.
9,277,821 B2 3/2016 Jones et al.
9,504,330 B2 11/2016 Gehner et al.
9,554,652 B2 1/2017 Birkbeck
2011/0101748 A1 5/2011 Goetz
2013/0113252 A1 5/2013 Kuenzler
2013/0169016 A1 7/2013 Meyuhas
2013/0169017 A1 7/2013 Masunaga et al.
2013/0200674 A1 8/2013 Jones et al.
2014/0132051 A1 5/2014 Freedman
2014/0159458 A1 6/2014 Lu et al.
2014/0239687 A1 8/2014 Hazzard et al.
2014/0265460 A1 9/2014 Voigt et al.

FOREIGN PATENT DOCUMENTS

WO 2014009147 A1 1/2014
WO 2014021796 A1 2/2014
WO 2014029696 A1 2/2014
WO 2014036633 A1 3/2014
WO 2014059553 A1 4/2014
WO 2014131689 A1 9/2014
WO 2014177445 A1 11/2014

* cited by examiner

FORWARD TILT ASSEMBLY FOR CHAIR SEAT

BACKGROUND OF THE INVENTION

The present invention relates to an office chair, and more particularly to a forward tilt assembly for the office chair to selectively tilt the chair seat forward.

Conventional office chairs are designed to provide significant levels of comfort and adjustability. Office chairs commonly provide rearward vertical reclining of the seat and back relative to the chair base. The seat and back assemblies are typically urged by springs into a normal position where the seating surface is approximately horizontal or slanted rearward at a small angle. In such chairs, a recline control mechanism typically connects the seat and back assemblies so that they may recline rearward together in response to movements by the chair occupant. Further, such chairs typically permit the back to also move relative to the seat during such rearward reclining, which is sometimes referred to as a synchro-tilt. Chairs having such construction are conventional, and have been utilized in offices and other environments for many years.

Chairs have also been developed which enable the seat to effectively pivot forward from the normal upright position. That is, the rear portion of the seat can be moved upward (or the front portion moved downward) such that it slopes downward in a forward direction so that the rear of the seat is at an elevation above, or level with, the front of the seat. This forward tilt feature on the seat has been found to be highly desirable for individuals who like to sit on the front edge of the chair or for those in many of the more intensive work environments, such as when the chair occupant is working on a keyboard. However, if not supported properly, the tilted posture may increase ergonomic risks due to reduced support from the chair seat. Further, including a forward seat tilt feature, especially into chairs that also include synchronous rearward reclining of the seat and back has created complications regarding the lack of physical space on/under the chair seat for all of the components required for these features.

SUMMARY OF THE INVENTION

The present invention provides a compact and easy-assembly forward tilt assembly for a chair. In one embodiment, the forward tilt assembly is configured to upwardly lift a rear of a chair seat with respect to the front of the chair seat. The forward tilt assembly generally includes a base, a seat plate, and a release mechanism. The seat plate is pivotally mounted to the base and is configured to support the chair seat. The seat plate may include two support brackets that extend down from the longitudinal sides of the seat plate, and each support bracket may include a keyhole slot. The release mechanism may be operable between locked and unlocked positions and may include a laterally slidable lock pin mounted between the support brackets. In one embodiment, the release mechanism also includes a biasing element and two keyed collars. One of the two collars is disposed at each end of the lock pin, and the collars are configured for receipt in the respective keyhole slots of the support brackets. When the release mechanism is in the unlocked position, the collars are unobstructed from moving within the support brackets, and the support brackets and seat plate can selectively pivot relative to the base to tilt the rear of the chair seat.

In another embodiment, the forward tilt assembly and seat plate can pivot between a nominal position and a forward tilted position. In the nominal position, the collars are disposed within upper portions of the keyhole slots. In the forward tilted position, the collars are disposed within lower portions of the keyhole slots and the rear of the seat plate is lifted upward relative to the chair base. Lifting the rear of the seat generally tilts the chair seat forward, or at least tilts the rear of the seat upward with respect to the front of the seat.

In another embodiment, the forward tilt assembly includes an actuator configured to selectively slide the lock pin laterally, controlling the release mechanism to move between the locked and unlocked positions.

According to another embodiment, each collar includes a shaft and a head. In the locked position, the collars are obstructed from moving between the upper and lower portions of the keyhole slot. In the unlocked position, the lock pin and collars are translated laterally so that the heads of the collars are not received in the upper or lower portions of the keyhole slots and the collars are therefore unobstructed from moving between upper and lower portions of the keyhole slot.

In another embodiment, the head of each collar includes an upper tab and a lower tab, and the upper and lower portions of each keyhole slot include a complimentary recess. One of the tabs is disposed within one of the recesses (dependent on which of the nominal and forward tilted positions is selected) so that the orientation of the release mechanism is maintained relative to the support brackets and seat plate, even during reclining of the chair seat and back.

Before the current embodiments of the invention are described, it is pointed out that the terminology used herein is for the purpose of description and should not be regarded as limiting. It should be noted that directional terms, such as "upper," "lower," "vertical," "horizontal," "forward," and "rearward" are used to assist in describing the invention based on the orientation of the embodiments shown in the illustrations in relation to an occupant of the chair. For instance, the term "forward" refers to a direction moving away from the seat back and in front of a chair occupant, while the term "rearward" refers to a direction opposite of the forward direction. Further, the term "lateral" refers to a generally horizontal direction perpendicular to the forward and rearward directions, and "longitudinal" refers to a generally horizontal direction parallel to the forward and rearward directions. The use of directional terms should not be interpreted to limit the invention to any specific orientation.

DETAILED DESCRIPTION OF THE CURRENT EMBODIMENTS

Figure 1:
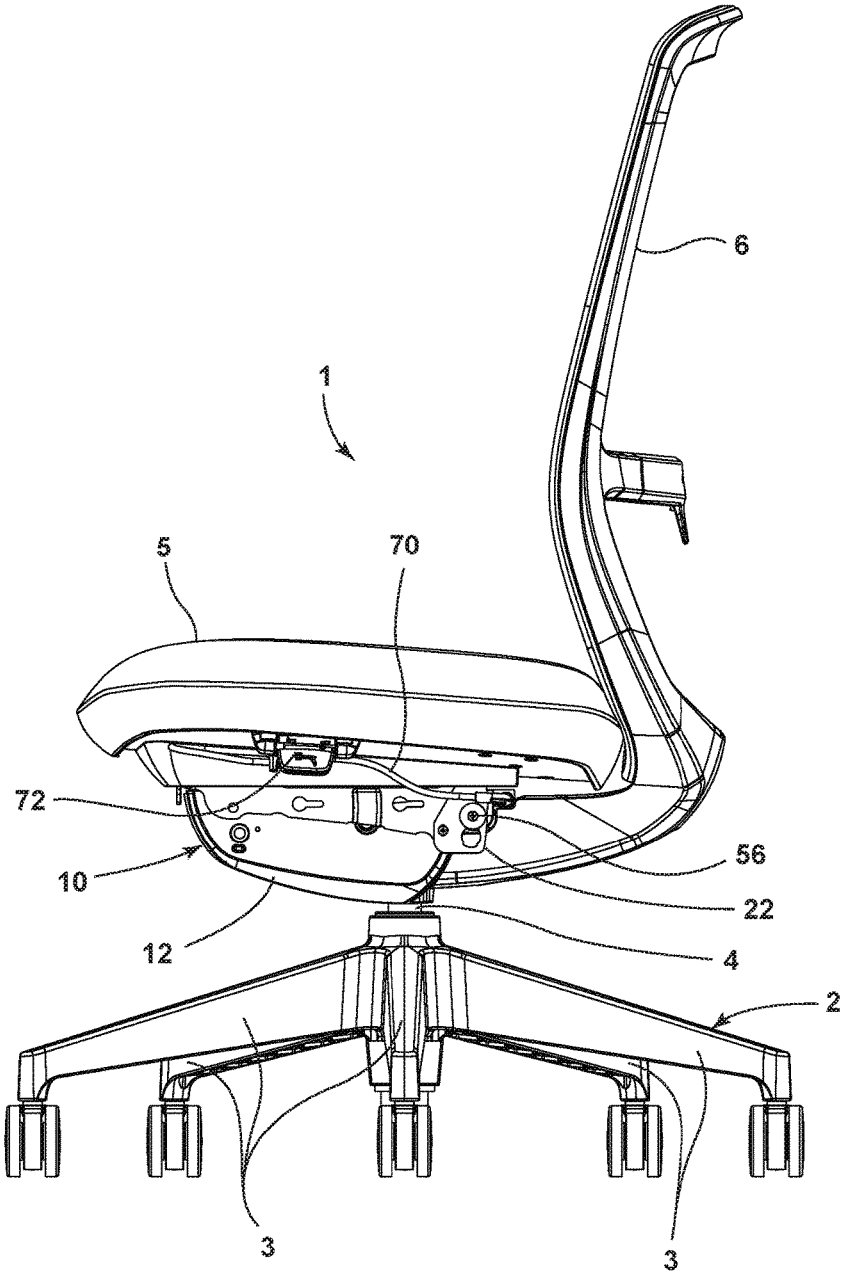
FIG. 1 is a perspective view of a chair including a forward tilt assembly according to an embodiment of the invention.

A forward tilt assembly for use with a chair 1 in accordance with an embodiment of the present invention is illustrated in the drawings and designated 10. In general, the invention relates to an office-type chair 1 that may include various inventive features therein to improve the overall comfort and adjustability of the chair. More particularly, this chair 1 includes a forward tilt assembly 10 that selectively enables a seat of the chair 1 to be tilted forward to adjust to the comfort preferences of the chair's occupant. The exemplary chair 1 shown in FIG. 1 generally includes a support base 2 with radially extending legs 3, an upright pedestal 4, and a seat-back arrangement that includes a chair seat 5 and a chair back 6. Additionally, a height adjustment mechanism may be supported atop the pedestal 4 to enable the height of the chair to be adjusted by an occupant.

Figure 2:
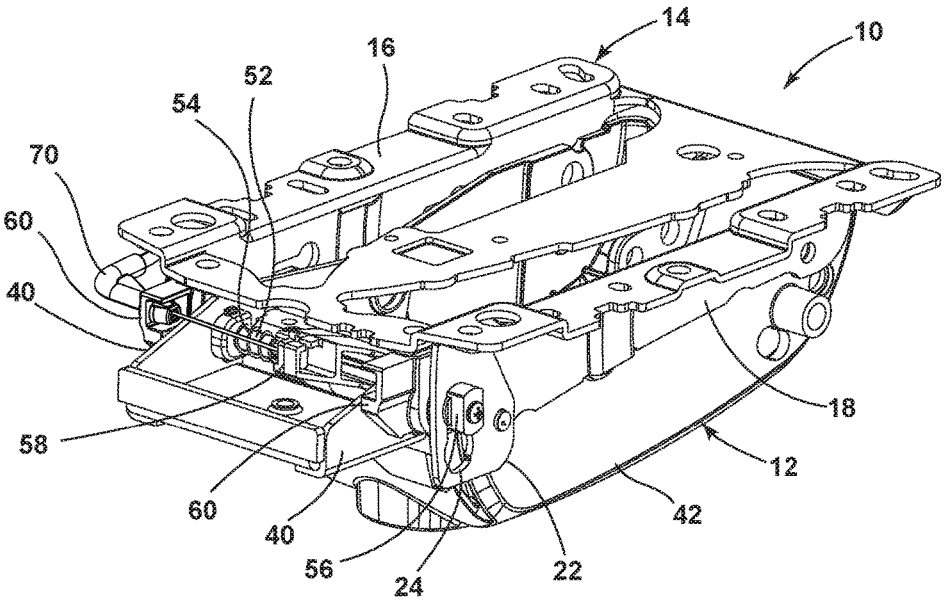
FIG. 2 is a perspective view of the forward tilt assembly.
Figure 3:
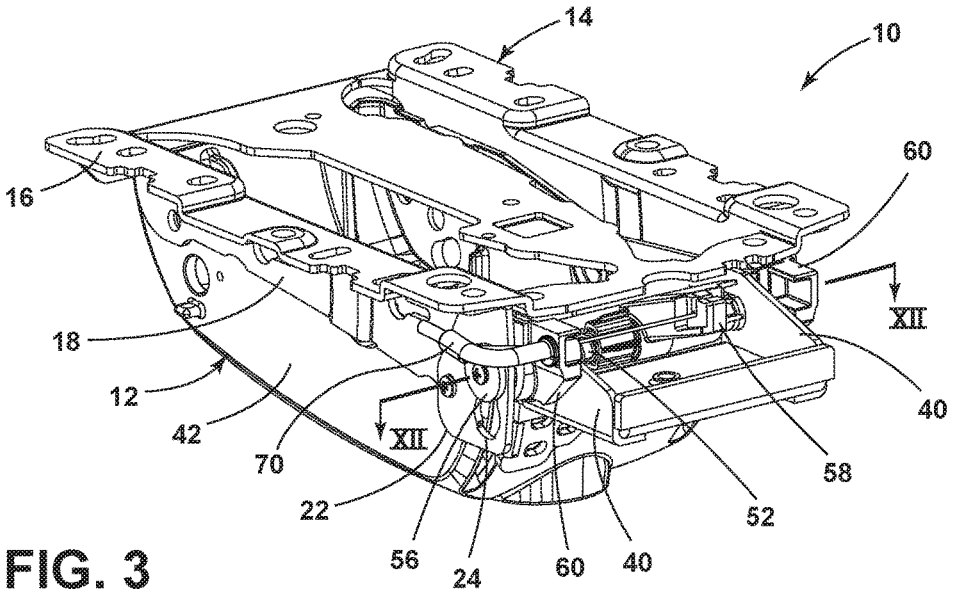
FIG. 3 is another perspective view of the forward tilt assembly.
Figure 4:
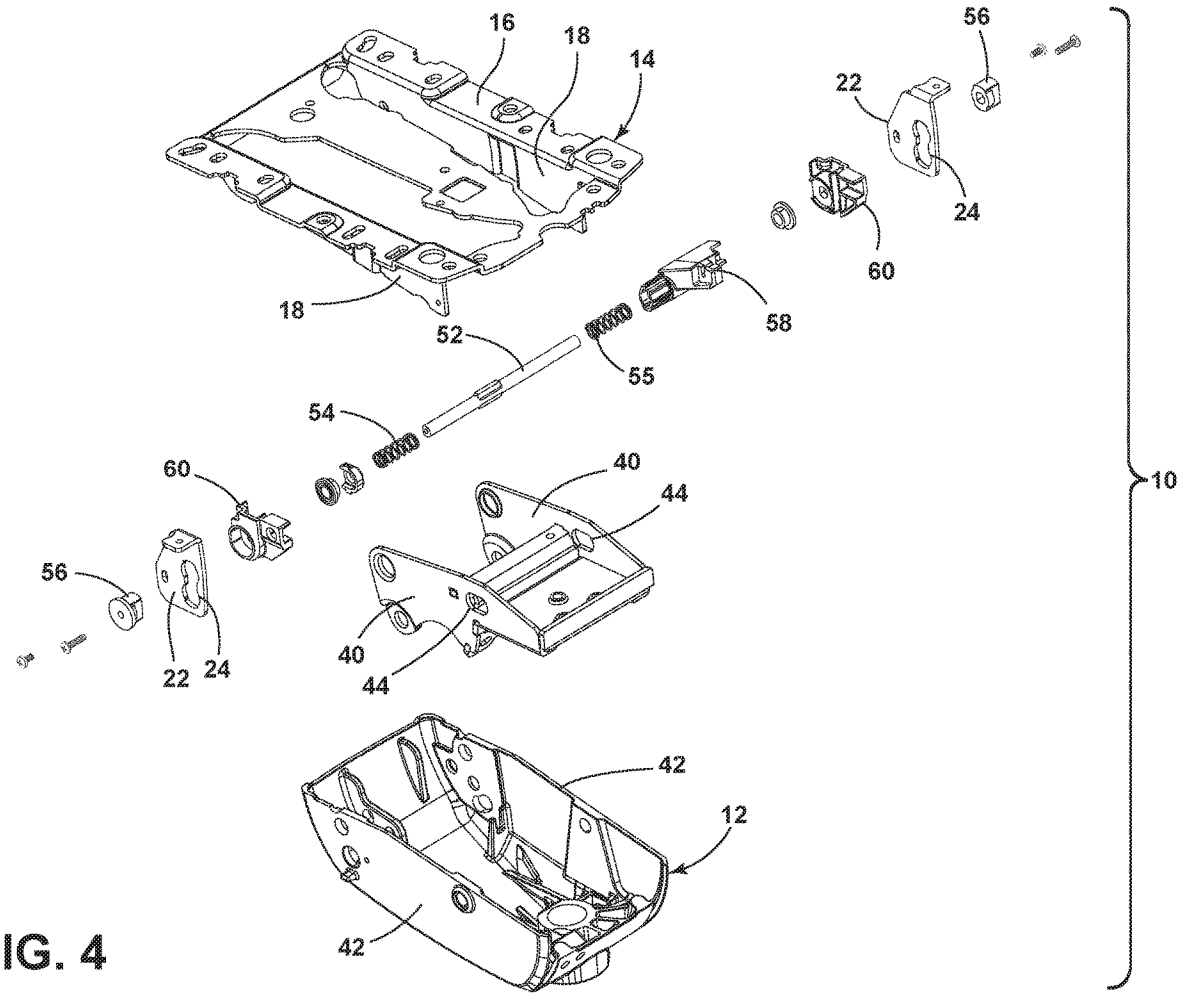
FIG. 4 is an exploded view of the forward tilt assembly.
Figure 5:
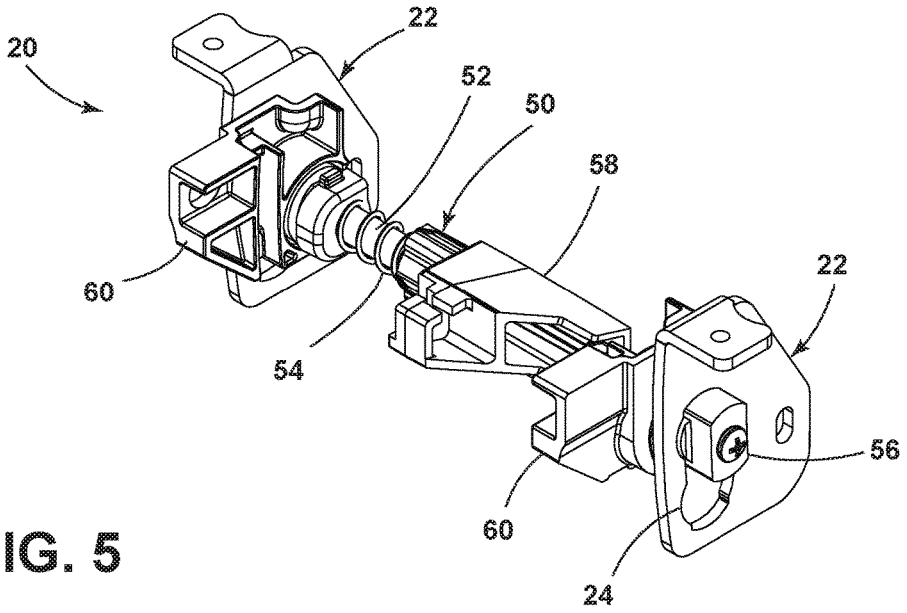
FIG. 5 is a perspective view of a tilt mechanism of the forward tilt assembly.
Figure 6:
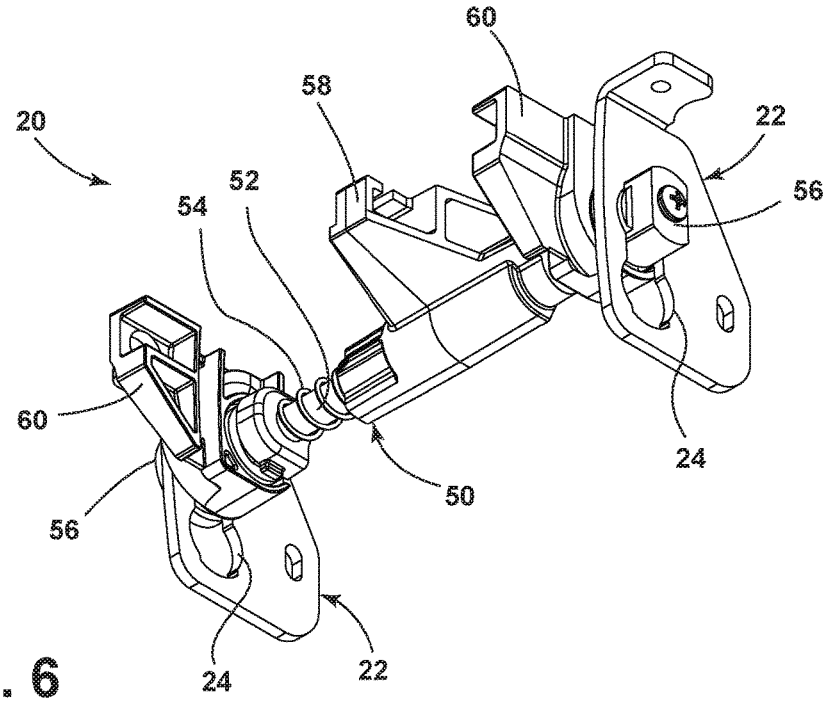
FIG. 6 is another perspective view of the tilt mechanism.
Figure 7:
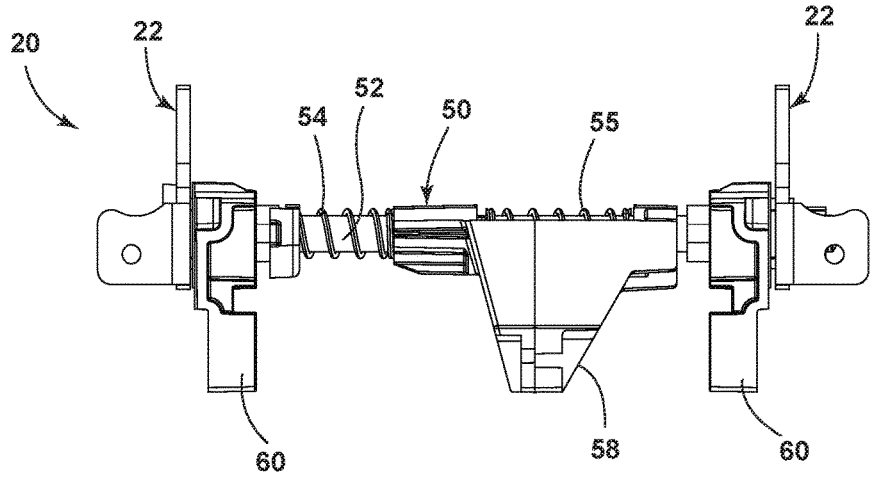
FIG. 7 is a top view of the tilt mechanism.
Figure 8:
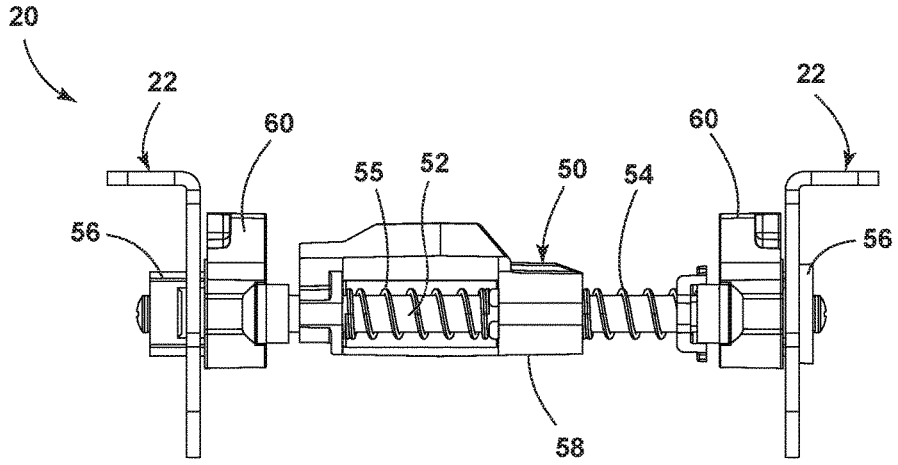
FIG. 8 is a rear view of the tilt mechanism.
Figure 9:
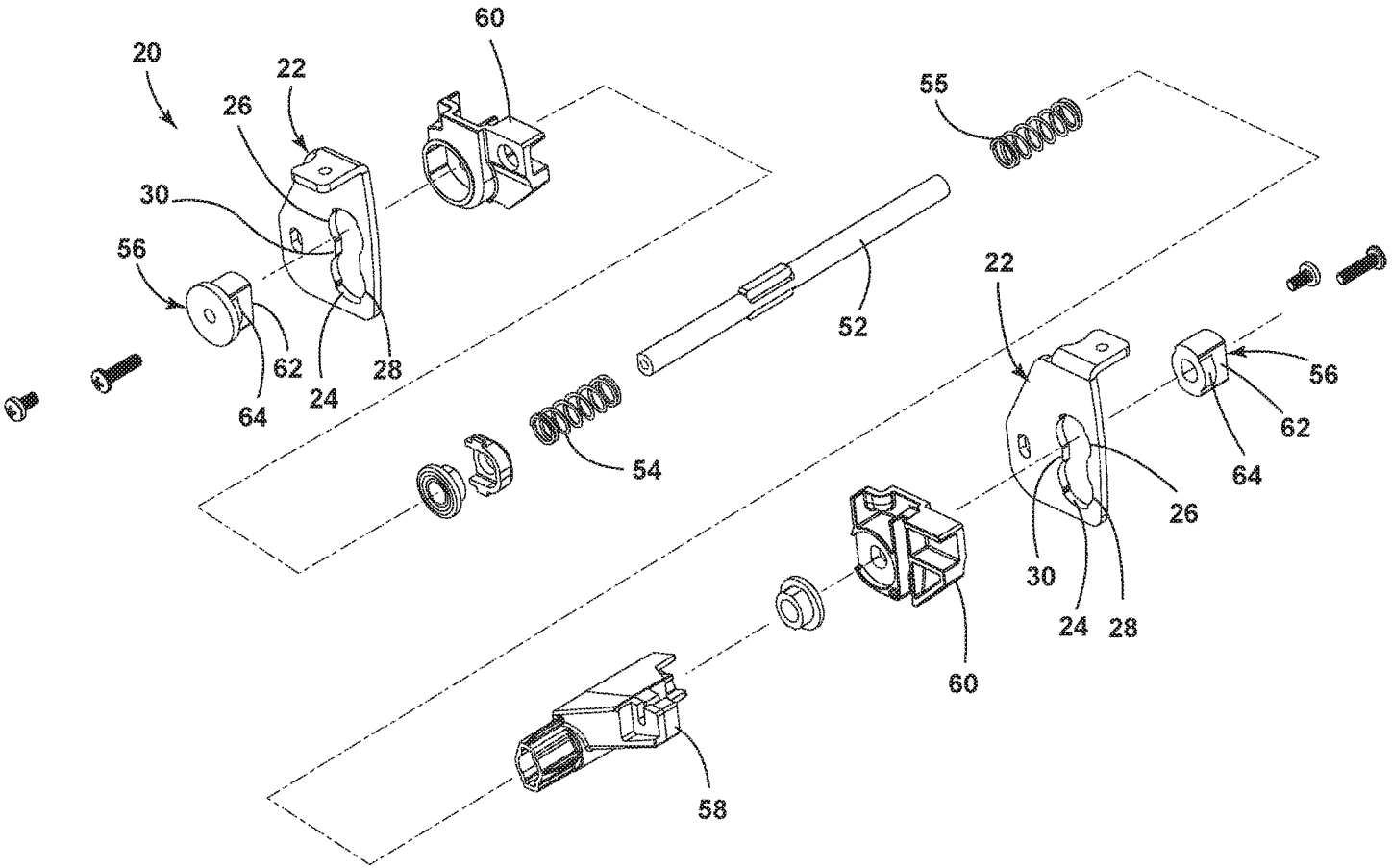
FIG. 9 is an exploded view of the tilt mechanism.

Referring to FIGS. 1-3, the forward tilt assembly 10 is operable to lift a rear of the seat 5 upward, thereby tilting the seat 5 and an occupant seated in the chair forward. The forward tilt assembly 10 includes a base 12 that is supported atop the pedestal 4. The forward tilt assembly 10 includes a seat plate 14 pivotally mounted to the base 12, the pivot axis positioned toward a forward portion of the base 12. The seat plate 14 has a generally planar upper surface 16 and the chair seat 5 is affixed to the upper surface 16 of the seat plate 14. The seat plate 14 also includes spaced side rails 18 that extend below the upper surface 16.

Referring now to FIGS. 2-10, the forward tilt assembly 10 includes a tilt mechanism 20 which generally includes two spaced support brackets 22 and a release mechanism 50. The support brackets 22 extend downward from the upper surface 16 of the seat plate 14 and are disposed adjacent the side rails 18 near a rear portion of the seat plate 14. The support brackets 22 may be integrally formed with the seat plate 14 or may be separate components affixed to the seat plate 14, as illustrated in the drawings. The support brackets 22 each include a substantially vertically oriented keyhole slot 24. The keyhole slot 24 is also slightly arcuate to follow the pivot path of the seat plate 14. Additionally, the keyhole slot 24 defines an upper portion 26 and a lower portion 28 connected by a middle portion 30. The upper and lower portions 26, 28 are substantially circular. In particular, as illustrated in FIG. 11, the upper and lower portions 26, 28 of each keyhole slot 24 define a diameter $D_K$, and the middle portion 30 of each keyhole slot 24 defines a width $W_K$ that is less than the diameter $D_K$ of the upper and lower portions 26, 28.

The base 12 is formed as a metal casting that can be mounted to the upper end of the pedestal 4. Although not shown, components related to reclining the chair back 6 can be housed within the base 12, including a coil spring, controls, and adjustment assemblies provided for adjusting and actuating the various features of the chair 1. The base 12 also includes a pair of spaced side brackets 40 that extend rearward from the base 12 and are pivotally mounted to sidewalls 42 of the base 12. The pivoting movement of the side brackets 40 relative to the base 12 is what enables the affixed chair back 6 to recline. Further, the side brackets 40 include lock pin holes 44, the purpose of which will be described below.

Figure 12:
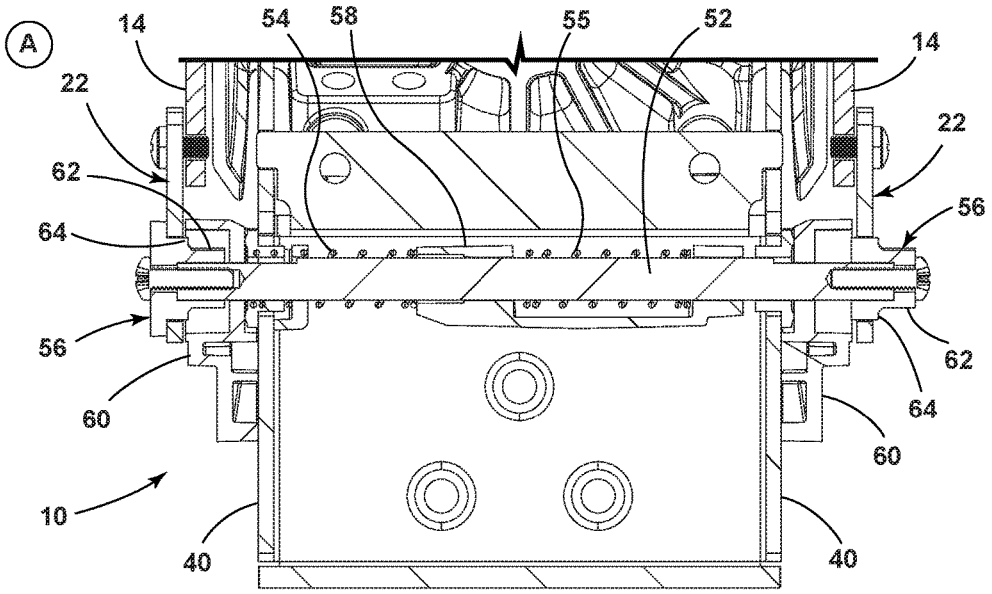
FIG. 12 is a cross-sectional view of the forward tilt assembly taken along line XII-XII of FIG. 3 and illustrating the release mechanism in a locked position.
Figure 13:
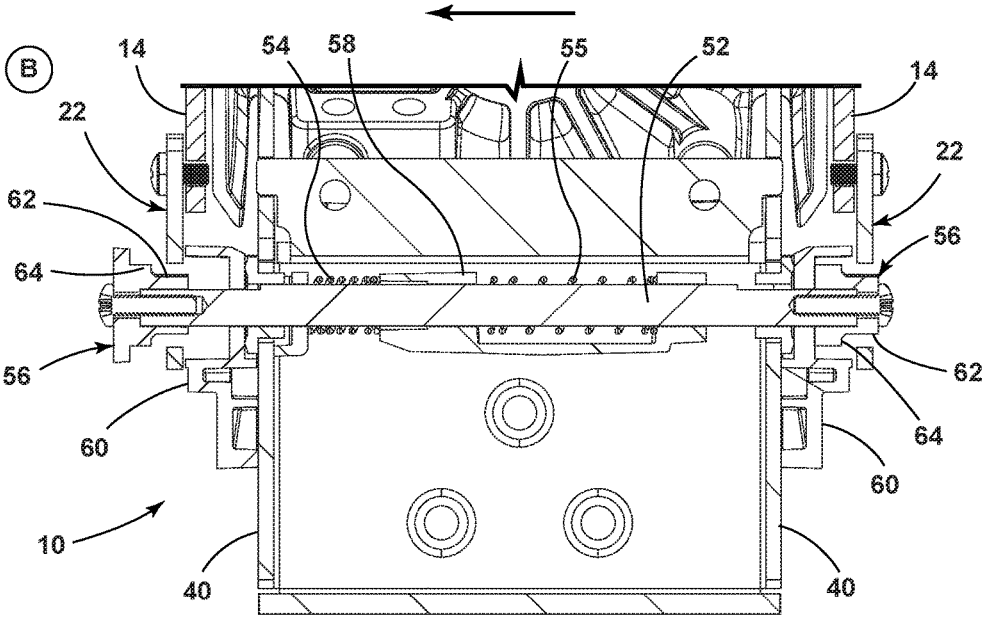
FIG. 13 is a cross-sectional view of the forward tilt assembly taken along line XII-XII of FIG. 3 and illustrating the release mechanism in an unlocked position.

The tilt mechanism's release mechanism 50 is operable between a locked position A and an unlocked position B, as illustrated in FIGS. 12 and 13. The release mechanism 50 generally includes a lock pin 52, a biasing element shown in the form of a spring 54, and two keyed collars 56. The lock pin 52 is positioned between the support brackets 22 and can translate or slide in at least one lateral direction. The release mechanism 50 also includes a spring compression member 58, and the lock pin 52 extends through the spring 54 and spring compression member 58. Additionally, the release mechanism may include two springs—one spring being the return spring 54, and a second spring is an activation spring 55.

The release mechanism has one collar 56 positioned at each end of the lock pin 52 and received within the respective keyhole slot 24 of the support bracket 22. Further, a bushing 60 can be disposed between the side bracket 40 and support bracket 22, on each end of the release mechanism 50. The bushing 60 includes a central hole through which the lock pin 52 passes. The bushings 60 provide spacing between the side brackets 40 and their respective support brackets 22, as well as provide structure for attaching or mounting other components thereto. The bushings 60 also provide structure to block and prevent a user's finger from reaching inside keyhole slot 24 and potentially being pinched during seat movement.

Figure 10:
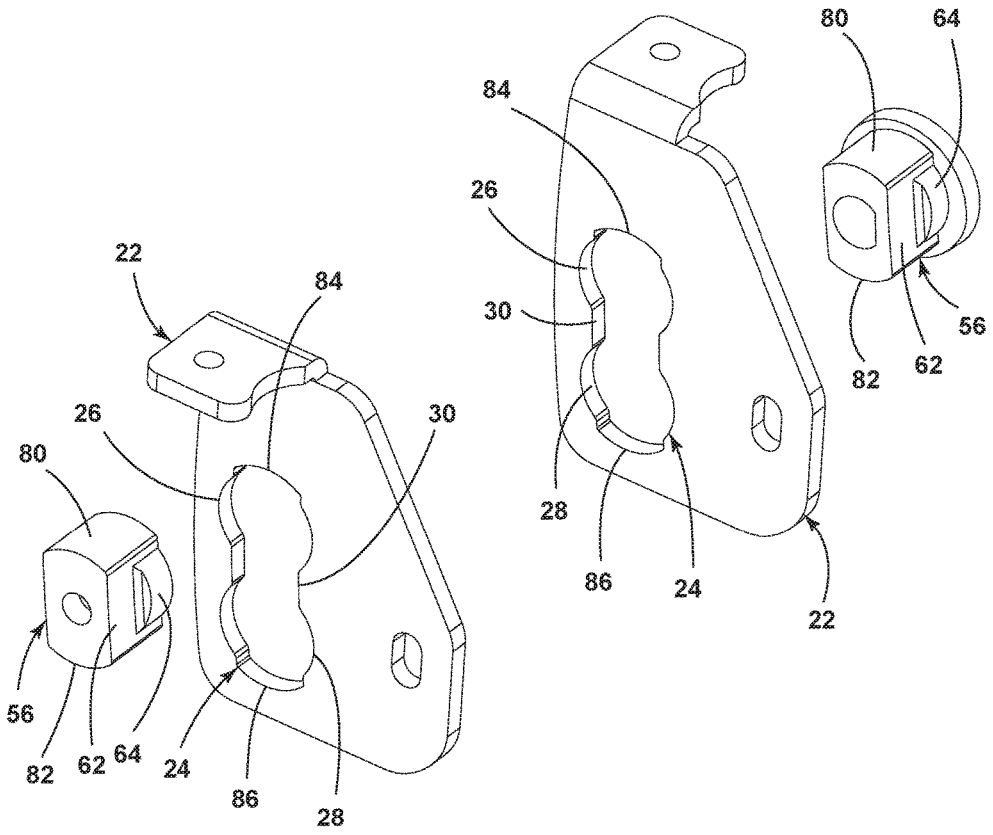
FIG. 10 is a perspective view of support brackets and collars included in the tilt mechanism.
Figure 11:
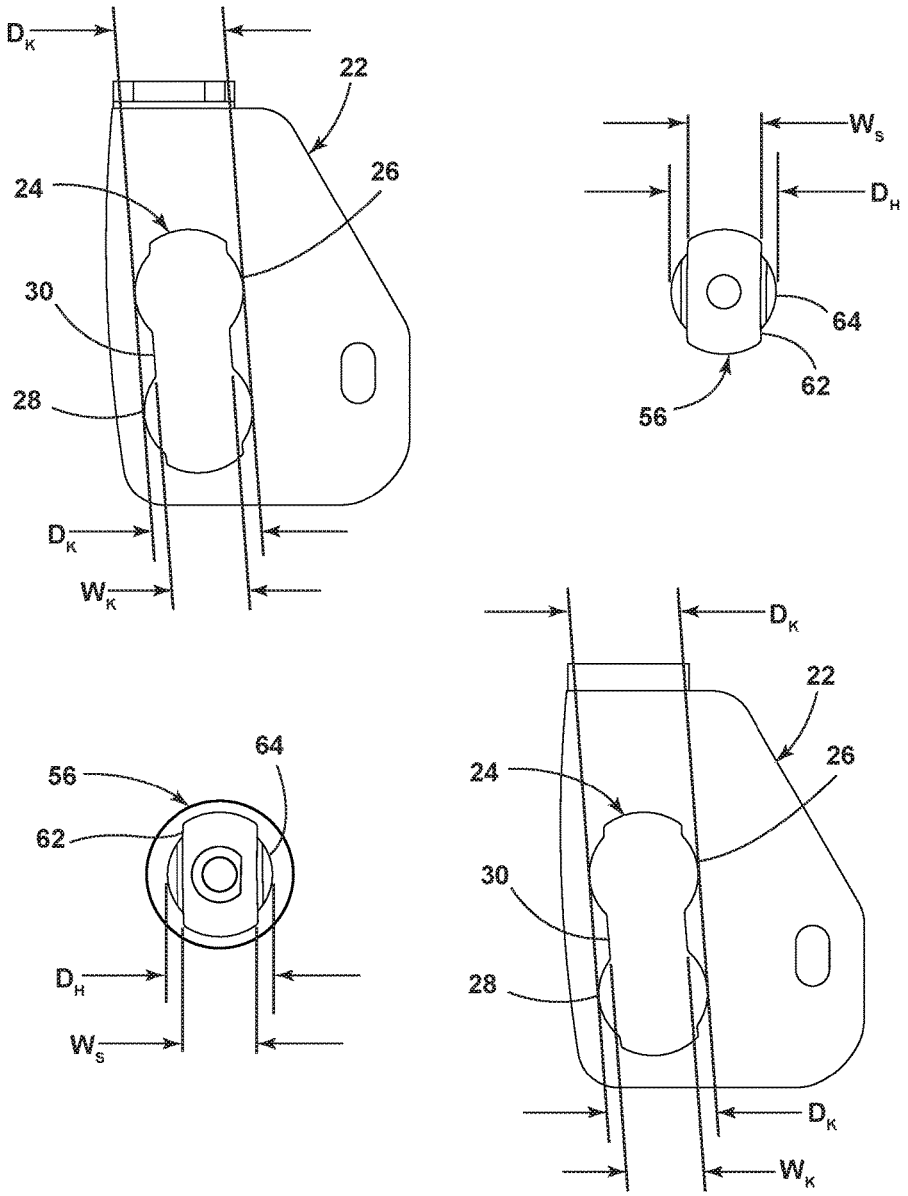
FIG. 11 is a side view of the support brackets and collars.

Referring now to primarily FIGS. 10 and 11, each collar 56 includes a shaft 62 and a head 64. The shaft 62 defines a width $W_S$ and the head 64 defines a diameter $D_H$. The head 64 diameter $D_H$ is greater than the width $W_S$ of the shaft 62. The collars 56 are positioned on the ends of the lock pin 52 and are oriented facing the same direction. For example, referring to the orientation shown in FIGS. 5 and 9, the first collar 56 at the left end of the lock pin 52 is oriented with its head 64 to the left of the shaft 62. The second collar 56 at the right end of the lock pin 52 is oriented the same—with its head 64 to the left of the shaft 62. The same orientation of the collars 56 is relevant to the lateral sliding or translation of the release mechanism 50 when moving between the locked and unlocked positions A and B, as described in greater detail below.

The release mechanism 50 extends laterally across the width of the base 12, and is positioned at or near the rear of the base 12. The release mechanism 50 extends through the lock pin holes 44 of the side brackets 40, through the bushings 60, and into the keyhole slots 24 of the support brackets 22. The spring 54 and spring compression member 58 are disposed between the side brackets 40. Notably, the connection between the release mechanism 50 and the side brackets 40, via the lock pin 52 and holes 44, provides that the release mechanism 50 moves in unison with the side brackets 40 when the chair back 6 is reclined. Specifically, when the chair back 6 is reclined, the release mechanism 50 and seat plate 14 pivot, or recline, with the side brackets 40.

The tilt mechanism 20 can be locked and unlocked by controlling the release mechanism 50 and its interaction or fit within the support brackets 22. In particular, the diameters $D_K$ of the upper and lower portions 26, 28 of the keyhole slot 24 and the diameter $D_H$ of the head 64 of the collar 56 are substantially the same so as to closely receive the head 64 within the upper or lower portion 26, 28. Further, the width $W_K$ of middle portion 30 of the keyhole slot 24 is less than the diameter $D_H$ of the head 64 and greater than the width $W_S$ of the shaft 62 of the collar 56.

In the locked position A illustrated in FIG. 12, the release mechanism 50 is positioned so that the collars 56 are received in either one of the upper and lower portions 26, 28 of the keyhole slots 24. More specifically, the head 64 of each collar 56 is received in the upper or lower portion 26 or 28 of the keyhole slots 24. Because the diameters $D_K$ and $D_H$ of the upper and lower portions 26, 28 of the keyhole slot 24 and the head 64 of the collar 56 are substantially the same, the collars 56 are obstructed by the narrower middle portion 30 of the support brackets 22 from moving between the upper and lower portions 26, 28. Additionally, the return spring 54 biases the release mechanism 50 to the locked position A.

In the unlocked position B illustrated in FIG. 13, the lock pin 52 and collars 56 are moved laterally (translated) so that the head 64 of each collar 56 is no longer received in the upper or lower portion 26 or 28 of the keyhole slots 24. In the unlocked position B, the shaft 62 of each collar 56 is positioned within the upper or lower portion 26 or 28 of the keyhole slots 24. Because the shaft 62 has a width $W_S$ less than the diameter $D_K$ of the upper and lower portions of the keyhole slot 24 and less than the width $W_K$ of the middle portion 30, the collars 56 are free to move within the keyhole slots 24. Thus, the collars 56 are unobstructed from moving between upper and lower portions 26, 28 of the keyhole slots 24.

Figure 14:
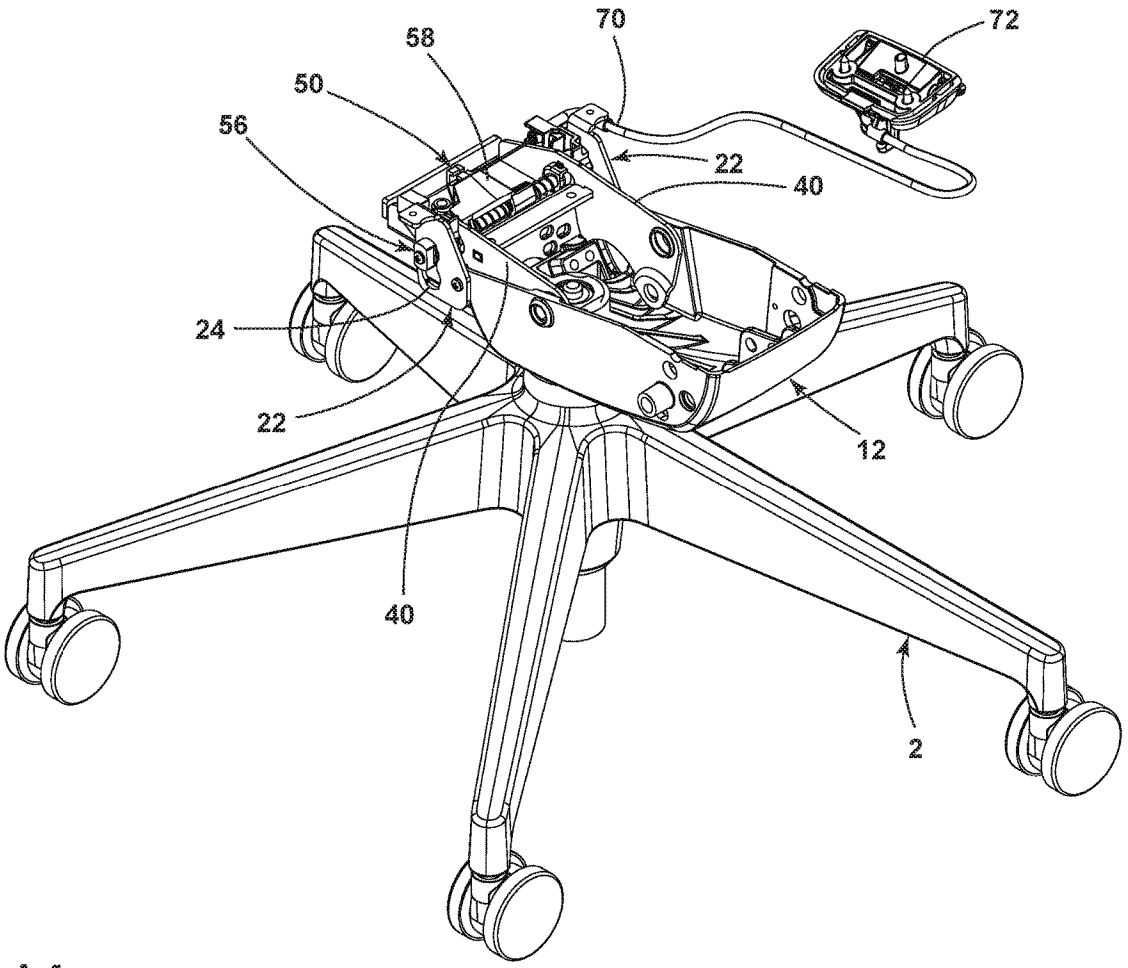
FIG. 14 is a top perspective view of a portion of the chair and the forward tilt assembly with a seat plate removed.

As shown in the figures, and in particular in FIG. 14, the tilt mechanism 20 can also include an actuator to effect movement of the release mechanism 50 between the locked and unlocked positions A, B. For example, the actuator could be a cable actuator 70 with a control button 72. The cable actuator 70 is affixed to the spring compression member 58 and is configured to selectively slide the spring compression member 58 in the lateral direction. Sliding the spring compression member 58 in the lateral direction compresses the return spring 54 and loads the activation spring 55 to laterally slide the lock pin 52, thereby moving the release mechanism 50 to the unlocked position B (when the weight of the user is biased forward). The control button 72 may be mounted to an underside of the chair seat 5. Of course, other suitable mechanical or electrical means for laterally sliding the spring compression member 58 are also contemplated herein. Further, the release mechanism can eliminate one of springs, for example, the activation spring 55.

Referring back to FIG. 10, the head 64 of each collar 56 can include an upper tab 80 and a lower tab 82 that extend outward from the head 64 diameter $D_H$. Additionally, the upper and lower portions 26, 28 of the keyhole slots 24 can include complimentary recesses—an upper recess 84 extending up from the upper portion 26 and a lower recess 86 extending down from the lower portion 28. The upper tab 80 is received within the upper recess 84, or the lower tab 82 is received within the lower recess 86. The tabs and recesses help maintain the proper orientation of the release mechanism 50 relative to the support brackets 22 when the forward tilt assembly 10 is tilted or during reclining of the chair seat 5 and back 6.

Figure 15:
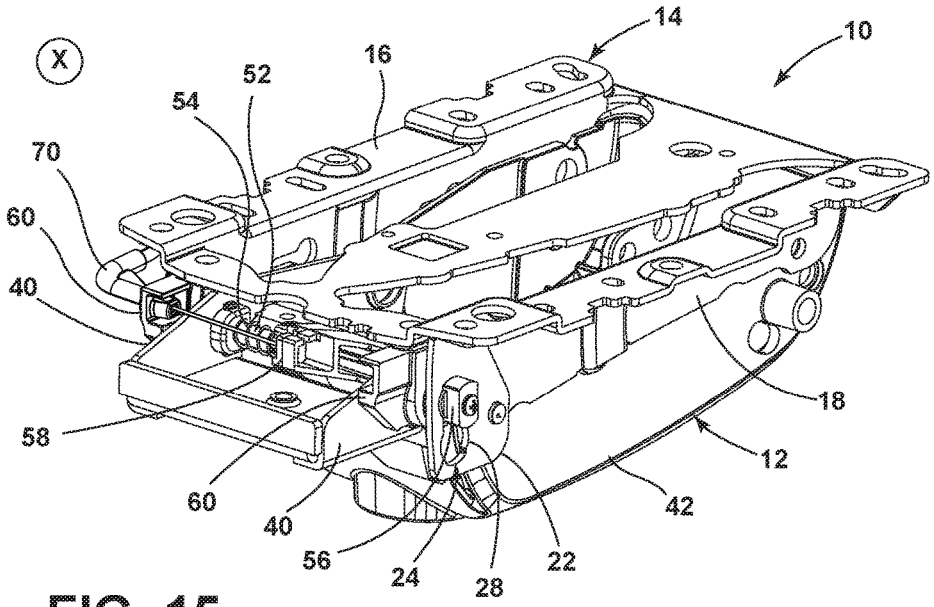
FIG. 15 is a perspective view of the forward tilt assembly, illustrating a nominal position.
Figure 16:
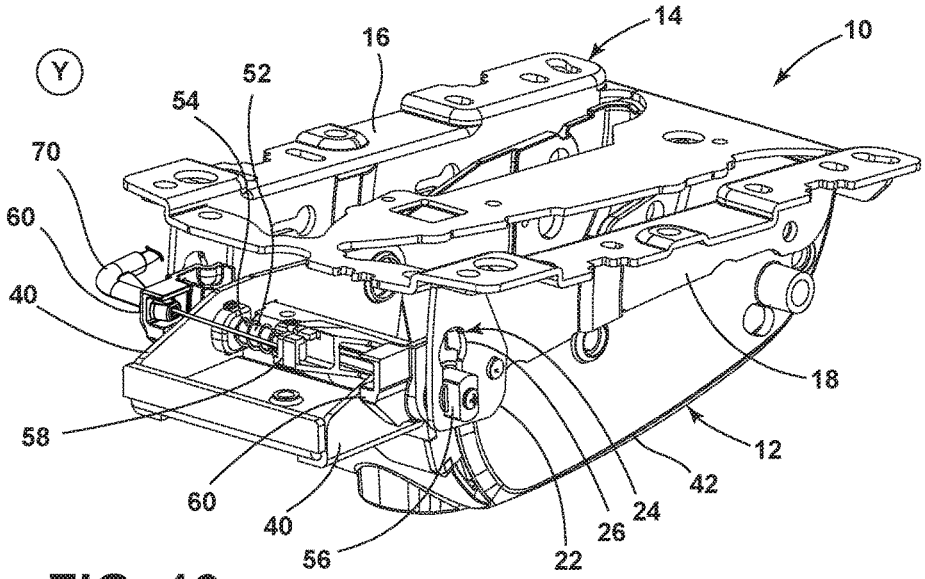
FIG. 16 is a perspective view of the forward tilt assembly, illustrating a forward tilted position.
Figure 18:
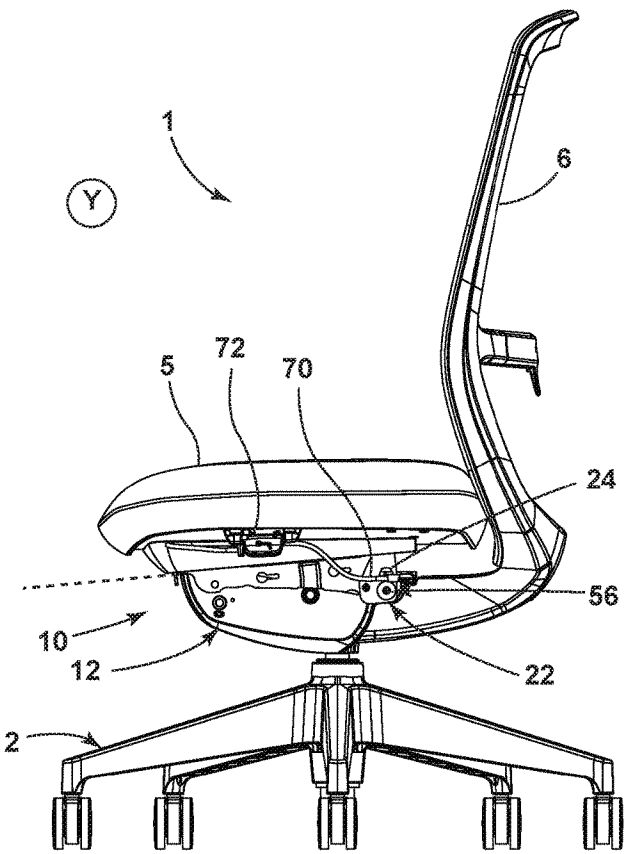
FIG. 18 is side view of the chair and forward tilt assembly, illustrating the forward tilted position.
Figure 17:
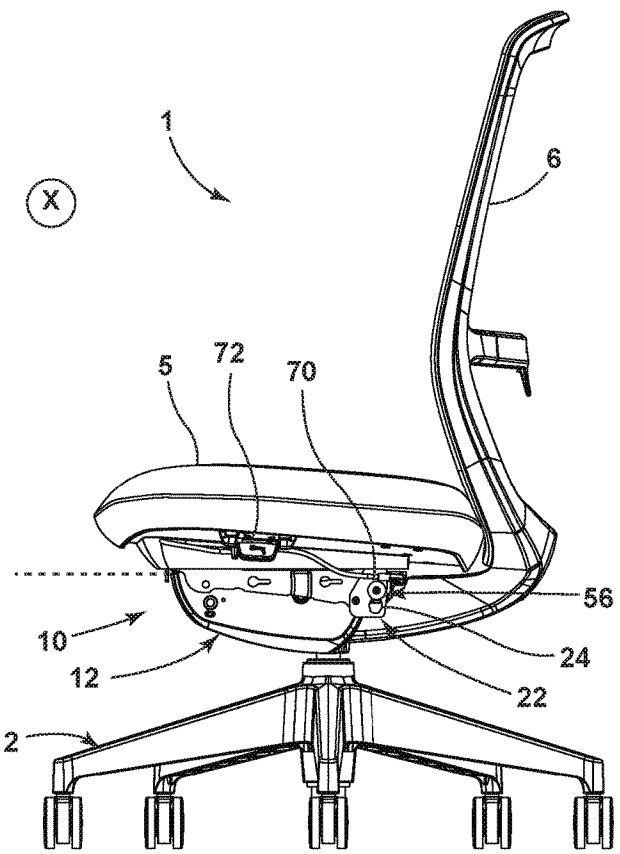
FIG. 17 is side view of the chair and forward tilt assembly, illustrating the nominal position.

The forward tilt assembly 10 is configured to forwardly tilt the chair seat 5 by raising the rear of the chair seat 5. The tilt mechanism 20 and chair seat 5 can be selectively positioned in a nominal position X, illustrated in FIG. 15, or a tilted position Y, illustrated in FIG. 16. In the nominal position X, the release mechanism 50, and more specifically, the collars 56 are positioned within the upper portions 26 of the keyhole slots 24. In the forward tilted position Y, the collars 56 are positioned within the lower portions 28 of the keyhole slots 24. Positioning the collars 56 in the lower portions 28 raises the rear of the seat plate 14 up. This lifts the rear of the seat plate 14 upward relative to the base 12, thus tilting the chair seat 5 forward. The chair 1 with the forward tilt assembly 10 and seat 5 in the nominal position X is illustrated in FIG. 17, and the chair 1 with the forward tilt assembly 10 and seat 5 in the forward tilted position Y is illustrated in FIG. 18. The dashed line in each of these figures extends from the seat plate 14 and illustrates the angle at which the seat 5 is tilted. Of note, chair seats 5 are often tilted rearward a small amount. That is, the front of the seat 5 may be higher than the rear of the seat 5, even in the nominal (no tilt) position. In this case, positioning the forward tilt assembly 10 in the forward tilted position Y may result in the seat 5 position being tilted only slightly forward. As a non-limiting example, the seat 5 in the nominal position X may be oriented at 3 degrees of rearward tilt, and the forward tilt assembly 10 may raise the rear of the seat plate 14 up by 5 degrees; therefore the forward tilted position Y is −2 degrees of forward tilt. Of course, more or less nominal tilt may be designed into the chair 1, and more or less forward tilt as described herein may be provided by the forward tilt assembly 10.

In use of the forward tilt assembly 10, a user can tilt the chair seat 5 forward by actuating the control button 72 of the cable actuator 70 and leaning slightly forward. This moves the release mechanism 50, under the bias of the activation spring 55, to the unlocked position B, where the collars 56 are free to move within the keyhole slots 24. From the nominal position X and with the release mechanism 50 unlocked, the chair occupant can simply continue leaning forward in the chair 1 to shift their weight to the front of the chair seat 5, causing the rear of the seat plate 14 to pivot up and move the collars 56 from the upper portion 26 to the lower portion 28 of the keyhole slots 24. Once the forward tilted position Y has been achieved, the occupant may release the control button 72, and the return spring 54 will urge the release mechanism 50 back to the locked position A. The same procedure is followed to tilt the chair seat 5 back to the nominal position X, except that the occupant simply leans back in the chair 1 to cause the collars 56 to move back to the upper portions 26 of the keyhole slots 24.

The forward tilt assembly 10 is particularly helpful to a user who tends to sit on the front edge of the chair. This posture is often referred to as "perching." However, without proper support from the chair seat 5, this posture may increase ergonomic risks. The forward tilt of the chair seat 5 as provided by the forward tilt assembly 10 can support this seating style while promoting a healthy spinal posture. Tilting the seat 5 forward provides an alternative sitting posture and can help relieve lower back pressure.

Figure 20:
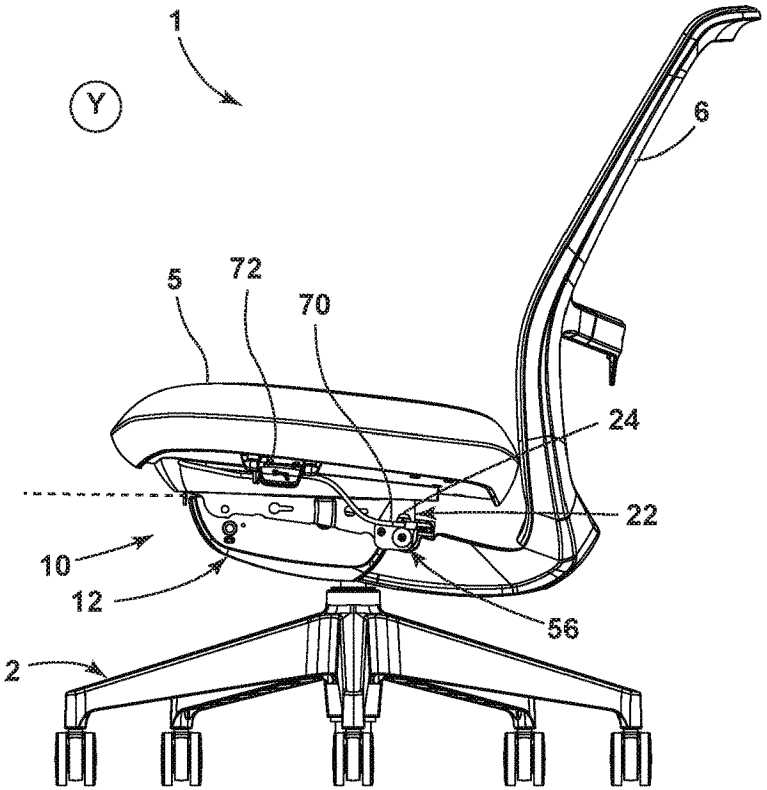
FIG. 20 is side view of the chair in a reclined position and the forward tilt assembly in the forward tilted position.
Figure 19:
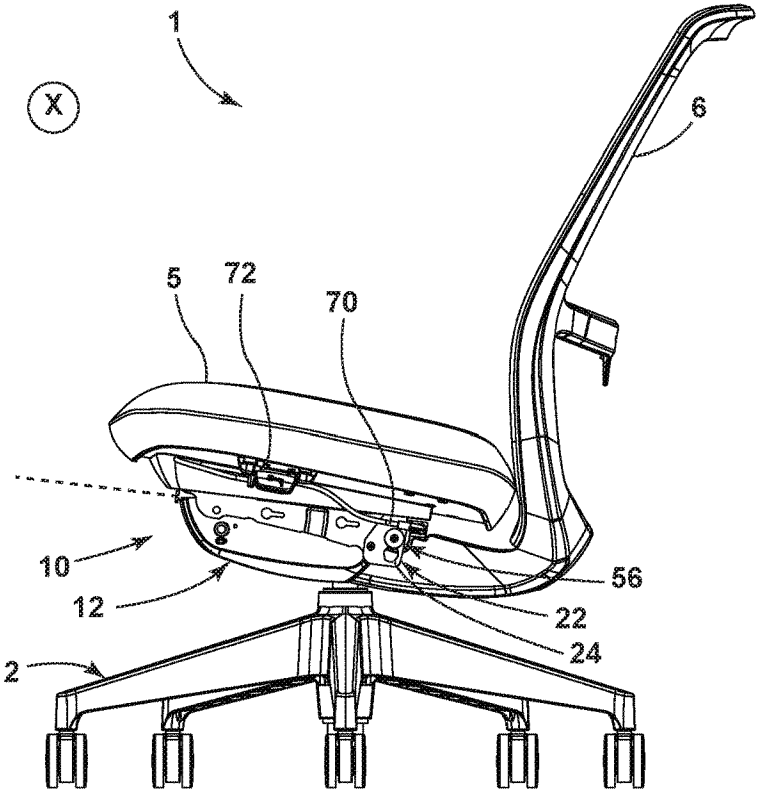
FIG. 19 is side view of the chair in a reclined position and the forward tilt assembly in the nominal position.

Further, and referring to FIGS. 19 and 20, the nominal and forward tilted positions X, Y described herein are seat positions independent of, though additive to, the reclined positions. For example, synchronous recline is a popular feature included in many office chairs. With synchronous recline, the motion of the seat back is linked with partial motion of the seat pan to maintain proper lower body and lumbar support throughout the recline motion. As discussed above, the forward tilt assembly 10 is directly linked to the reclining components of the chair seat 5; thus, the chair 1 can be positioned in either of the nominal and forward tilted positions and still be able to recline, providing improved comfort and adjustability. FIG. 19 illustrates the chair 1 in the reclined position and the forward tilt assembly 10 in the nominal position X, and FIG. 20 illustrates the chair 1 in the reclined position and the forward tilt assembly 10 in the forward tilted position Y.

Advantageously, the chair 1 described herein includes a forward tilt assembly 10 that selectively enables a seat of the chair 1 to be tilted forward to address the comfort preferences of the chair's occupant. The office-type chair 1 improves the overall comfort and adjustability of the chair. In addition, the forward tilt assembly 10 enables a compact solution to providing forward tilt to the chair, solving the problem that the many comfort and adjustability components often included on office chairs creates relative to the lack of physical space required to include all these features.

The above description is that of the current embodiment of the invention. Various alterations and changes can be made without departing from the spirit and broader aspects of the invention.

The invention claimed is:

1. A forward tilt assembly configured to tilt forward a seat of a chair, the forward tilt assembly comprising:

a base;

a seat plate pivotally mounted to the base and configured to support the chair seat, the seat plate including two support brackets extending downward from longitudinal sides of the seat plate, each support bracket including a keyhole slot; and a release mechanism operable between locked and unlocked positions, the release mechanism comprising:

a lock pin mounted between the support brackets, the lock pin being laterally slidable;

a biasing element; and two keyed collars, one of the two collars disposed at each end of the lock pin, the collars configured for receipt in respective keyhole slots of the support brackets, wherein when the release mechanism is in the unlocked position, the collars are unobstructed from moving within the support brackets, and the support brackets and seat plate can selectively pivot relative to the base, thereby tilting a rear of the chair seat.

2. The forward tilt assembly of claim 1, wherein the keyhole slot in the support bracket includes an upper portion, a lower portion, and a middle portion therebetween, wherein the upper and lower portions are substantially circular.

3. The forward tilt assembly of claim 2, wherein the collar includes a shaft defining a width and a circular head defining a first diameter, the first diameter being greater than a width of the shaft.

4. The forward tilt assembly of claim 3 wherein the upper and lower portions of the keyhole slot define a second diameter, wherein the first and second diameters are substantially the same so as to closely receive the head of the collar in the upper or lower portion of the keyhole slot.

5. The forward tilt assembly of claim 4 wherein the middle portion of the keyhole slot has a width that is less than the diameter of the head of the collar and greater than the width of the shaft; whereby, when the release mechanism is in the locked position the collar is obstructed from moving between the upper and lower portions of the keyhole slot.

6. The forward tilt assembly of claim 5, wherein when the release mechanism is moved to the unlocked position, the lock pin and collars slide laterally such that the head of each collar is no longer received in the upper or lower portions of the keyhole slots, and the shaft of each collar is free to move within the keyhole slots and the collars are unobstructed from moving between upper and lower portions of the keyhole slot.

7. The forward tilt assembly of claim 6 wherein the biasing element biases the release mechanism to the locked position.

8. A forward tilt mechanism for a chair configured to forwardly tilt a chair seat, the tilt mechanism comprising:

spaced support brackets positioned on opposing longitudinal sides of a seat plate, each support bracket including a keyhole slot having an upper portion and a lower portion, the seat plate being pivotally mounted to a forward portion of a chair base and configured to support the chair seat; and a release mechanism comprising:

a lock pin mounted between the support brackets, the lock pin being laterally slidable; and two keyed collars, one of the two collars disposed at each end of the lock pin, the collars configured for receipt in respective keyhole slots of the support brackets, wherein the seat plate is pivotable between a nominal position and a forward tilted position, wherein in the nominal position the collars are disposed within the upper portions of the keyhole slots, and in the forward tilted position the collars are disposed within the lower portions of the keyhole slots such that a rear of the seat plate is lifted upward relative to the chair base and the chair seat is tilted forward.

9. The forward tilt mechanism of claim 8, wherein the release mechanism is operable between locked and unlocked positions.

10. The forward tilt mechanism of claim 9, wherein the collar includes a shaft and a head.

11. The forward tilt mechanism of claim 10, wherein when the release mechanism is in the locked position, the collars are obstructed from moving between the upper and lower portions of the keyhole slot.

12. The forward tilt mechanism of claim 11, wherein when the release mechanism is in the unlocked position, the lock pin and collars are laterally slid such that the heads of the collars are not received in the upper or lower portions of the keyhole slots and the collars are unobstructed from moving between upper and lower portions of the keyhole slot.

13. The forward tilt mechanism of claim 9 including a spring configured to bias the release mechanism to the locked position.

14. The forward tilt mechanism of claim 8 including spaced side brackets that extend rearward from the base, the side brackets pivotally mounted to the base to enable a back of the chair to recline, wherein the release mechanism extends through the side brackets such that when the back of the chair reclines the release mechanism and seat plate pivot with the side brackets.

15. A forward tilt mechanism configured to upwardly lift a rear of a chair seat, the tilt mechanism comprising:

two spaced support brackets, each support bracket including a slot having an upper portion and a lower portion; and a release mechanism comprising:

a lock pin mounted between the support brackets, the lock pin being laterally slidable;

a spring and a spring sleeve; and two collars, one of the two collars disposed at each end of the lock pin, the collars configured for receipt in respective slots of the support brackets, the forward tilt mechanism is configured to pivot between a nominal position and a forward tilted position, wherein in the nominal position the collars are disposed within the upper portions of the slots, and in the forward tilted position the collars are disposed within the lower portions of the slots such that a rear of a chair seat is lifted upward.

16. The forward tilt mechanism of claim 15 wherein the release mechanism is operable between locked and unlocked positions.

17. The forward tilt mechanism of claim 16 wherein in the locked position, the collars are obstructed from moving between the upper and lower portions of the slots, and in the unlocked position, the collars are unobstructed from moving between the upper and lower portions of the slots.

18. The forward tilt mechanism of claim 15 including a cable actuator affixed to the spring sleeve, the cable actuator configured to selectively slide the spring sleeve in the lateral direction, compressing the spring and laterally sliding the lock pin, thereby moving the release mechanism to the unlocked position.

19. The forward tilt mechanism of claim 15 wherein at least one of the collars includes a shaft and a head; wherein in the locked position, the at least one collar is obstructed from moving between the upper and lower portions of the one slot within which the at least one collar extends, and in the unlocked position, the lock pin and the at least one collar are laterally slid such that the head of the collar is not received in the upper or lower portions of the one slot and the at least one collar is unobstructed from moving between upper and lower portions of the one slot.

20. The forward tilt mechanism of claim 19 wherein the head of the at least one collar includes an upper tab and a lower tab, and the upper and lower portions of the one slot include complimentary recesses shaped to match the respective upper and lower tabs.

* * * * *